US011273538B2

(12) United States Patent
Gibic et al.

(10) Patent No.: US 11,273,538 B2
(45) Date of Patent: Mar. 15, 2022

(54) PLIER WRENCH WITH REMOVABLE/REVERSIBLE JAW

(71) Applicant: Klein Tools, Inc., Lincolnshire, IL (US)

(72) Inventors: Amina Gibic, Mansfield, TX (US); Jordan L. Fisher, Dallas, TX (US)

(73) Assignee: Klein Tools, Inc., Lincolnshire, IL (US)

( * ) Notice: Subject to any disclaimer, the term of this patent is extended or adjusted under 35 U.S.C. 154(b) by 330 days.

(21) Appl. No.: 16/404,470

(22) Filed: May 6, 2019

(65) Prior Publication Data

US 2020/0353599 A1 Nov. 12, 2020

(51) Int. Cl.

| | |
|---|---|
| ***B25B 7/10*** | (2006.01) |
| ***B25B 7/04*** | (2006.01) |
| ***B25B 7/18*** | (2006.01) |

(52) U.S. Cl.

CPC ..... *B25B 7/10* (2013.01); *B25B 7/18* (2013.01); *B25B 7/04* (2013.01)

(58) Field of Classification Search

CPC .... B25B 7/10; B25B 7/02; B25B 7/04; B25B 7/12; B25B 7/14; B25B 7/18; B25B 13/00; B25B 13/10; B25B 13/105; B25B 13/12; B25B 13/16; B25B 13/18; B25B 13/20; B25B 13/22; B25B 13/48; B25B 13/56; B25B 13/58; B25G 1/105

See application file for complete search history.

(56) References Cited

U.S. PATENT DOCUMENTS

| | | | | |
|---|---|---|---|---|
| 3,664,214 A * | 5/1972 | Feldman | B25B 7/04 | 81/129.5 |
| 4,344,339 A * | 8/1982 | Penner | B25B 13/14 | 81/157 |
| 8,695,464 B2 * | 4/2014 | Herrmann | B25B 7/10 | 81/409 |
| 9,003,931 B2 * | 4/2015 | Phillips, Sr | B25B 7/12 | 81/423 |
| 9,862,074 B2 * | 1/2018 | Wang | B25B 7/14 | |

* cited by examiner

*Primary Examiner* — Robert J Scruggs

(57) ABSTRACT

A plier wrench is provided and includes a jaw that can be disengaged from the remainder of the wrench and reengaged with the remainder of the wrench while the remainder of the wrench remains in its fully assembled condition. In one form, the jaw is "reversible" and includes two different jaw surfaces that can be selectively utilized depending upon the type of workpiece that will be engaged by the plier wrench.

20 Claims, 13 Drawing Sheets

Fig. 26A
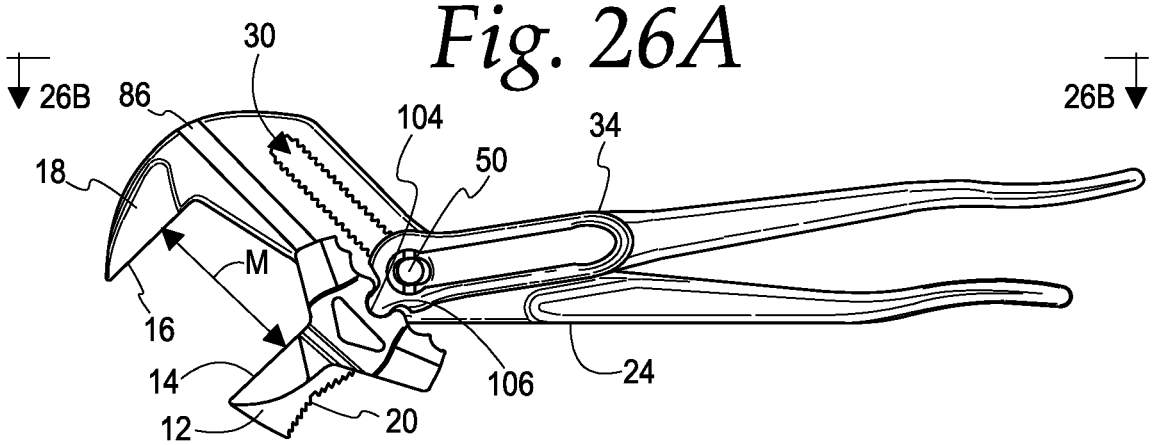
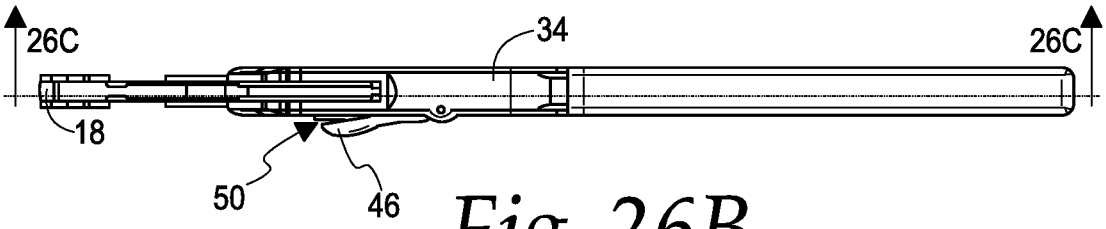
Fig. 26B
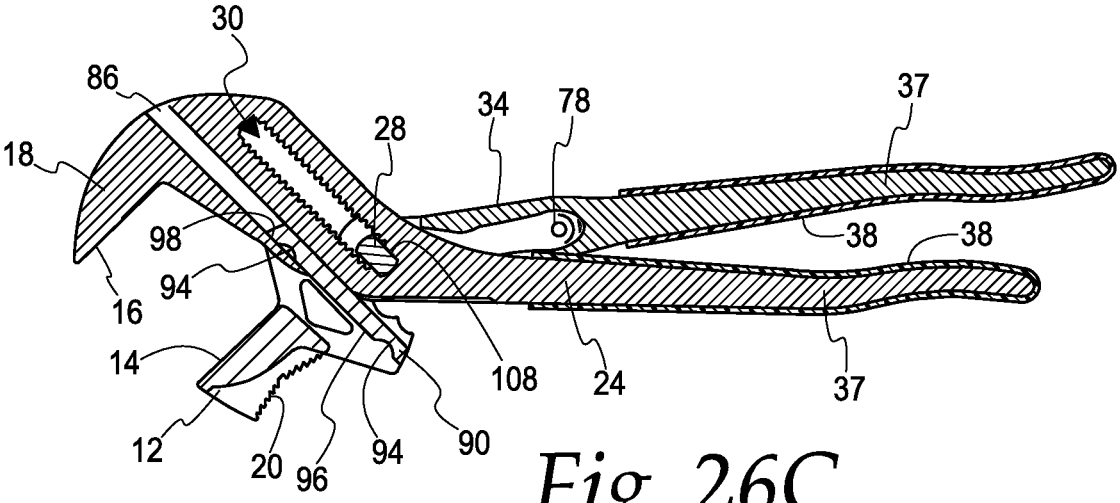
Fig. 26C

PLIER WRENCH WITH REMOVABLE/REVERSIBLE JAW

CROSS-REFERENCE TO RELATED APPLICATIONS

None

BACKGROUND OF THE DISCLOSURE

The present disclosure relates to pliers, and more specifically to of the so called "plier wrench" type wherein the jaws of the pliers are translated relative to each other by actuation of the plier handles between an open position wherein a workpiece can be received between the jaws and a gripping position wherein a workpiece is gripped between the jaws, and further wherein relative position between the jaws can be adjusted to accommodate a wide variation in the sizes of workpieces on which the plier wrench will be used. Many such plier wrenches are known and have proven suitable for their intended purpose, but there is always a continuing desire to improve such tools. For example, there is a continuing desire to make such tools more versatile. As another example, there is a continuing desire to increase the efficiency with which components of such tools can be removed for replacement, repair, and/or maintenance.

BRIEF SUMMARY OF THE DISCLOSURE

In accordance with one feature of this disclosure, an adjustable plier wrench includes a first jaw having a first surface to engage a workpiece, a second jaw having a second surface to engage a workpiece, a first handle having the first jaw fixed thereon, and a second handle. The first and second handles are operably engaged to translate relative to each other between a plurality of relative positions and to pivot relative to each other at each of the plurality of relative positions. The second handle is operably engaged with the second jaw to translate the second jaw relative to the first jaw as the first and second handles are translated to each of the plurality of relative positions. The second handle is operably engaged with the second jaw to translate the second jaw relative to the first jaw between an open position where a workpiece can be received between the surfaces of the jaws and a gripping position where a workpiece is gripped by the surfaces of the jaws in response to the first and second handles being pivoted relative to each other as each of the plurality of relative positions. The second jaw is configured to be manually disengaged from and reengaged to the remainder of the wrench without any disassemble of the remainder of the wrench with the first and second handles translated to a predetermined one of the plurality of relative positions and pivoted relative to each other to a jaw release position.

As one feature, the second jaw has a third surface to engage a workpiece, the second jaw surface and the third jaw surface face in opposite directions, and the second jaw can be selectively mounted on the remainder of the wrench in a first mounted orientation where the second jaw surface faces the first jaw surface to grip a workpiece therebetween or a second mounted orientation where the third jaw surface faces the first jaw surface to grip a workpiece therebetween.

In one feature, the second surface is a planar, smooth surface and the third surface is an arcuate or angled surface having teeth or knurls formed thereon.

According to one feature, the first jaw and the first handle are a single unitary part.

In a further feature, the unitary part has a linear slot formed therein, the second handle is pivot mounted to a carriage, and the carriage is mounted in the slot to translate the first and second handles relative to each other between each of the plurality of relative positions.

As one feature, the slot and the carriage include teeth that are selectively engageable with each other to retain the handles in each of the plurality of relative positions except for the predetermined one of the plurality of relative positions, and the slot has an end portion that is free of any of the teeth, and the first and second handles are positioned in the predetermined one of the plurality of relative positions when the carriage is located in the end portion of the slot.

According to one feature, the unitary part has a linear groove extending parallel to the linear slot, and the second jaw has a linear rib received in the linear groove for guided translation relative to the unitary part.

In a further feature, the unitary part has another linear groove extending parallel to the linear slot, the linear grooves are located on opposite sides of the unitary part, the second jaw has another linear rib received in the another linear groove for guided translation relative to the unitary part, and the second jaw has a pair of spaced side walls with one of the linear ribs fixed on one of the side walls and the other of the linear ribs fixed on the other of the side walls.

As one feature, the second handle and the second jaw have mating cam surfaces to transfer force from the second handle to the second jaw as the first and second handles are pivoted between the open and the gripping positions.

In a further feature, the first jaw has a concave recess defined by one of the mating cam surfaces and the first handle has a convex protrusion defined by the other of the mating cam surfaces.

In accordance with one feature of this disclosure, an adjustable plier wrench includes a first jaw having a first surface to engage a workpiece, and second jaw having a second surface to engage a workpiece and a third surface to engage a workpiece. The second jaw surface and the third jaw surface face in opposite directions. The wrench further includes a first handle fixed to the first jaw and a second handle, with the first and second handles being operably engaged to translate relative to each other between a plurality of relative positions and to pivot relative to each other at each of the plurality of relative positions. The second handle is operably engaged with the second jaw to translate the second jaw relative to the first jaw as the first and second handles are translated to each of the plurality of relative positions. The second handle is operably engaged with the second jaw to translate the second jaw relative to the first jaw between an open position where a workpiece can be received between the surfaces of the jaws and a gripping position where a workpiece is gripped by the surfaces of the jaws in response to the first and second handles being pivoted relative to each other as each of the plurality of relative positions. The second jaw can be selectively mounted on the remainder of the wrench in a first mounted orientation where the second jaw surface faces the first jaw surface to grip a workpiece therebetween or a second mounted orientation where the third jaw surface faces the first jaw surface to grip a workpiece therebetween.

According to one feature, the wrench further includes a guide structure fixed to the first jaw and the first handle intermediate the first jaw and the first handle, and the second jaw is configured to be manually disengaged from and reengaged to the remainder of the wrench without any disassemble of the remainder of the wrench with the first and second handles translated to a predetermined one of the plurality of relative positions and pivoted relative to each other to a jaw release position.

As one feature, the guide structure has a linear slot formed therein, the second handle is pivot mounted to a carriage, and the carriage is mounted in the slot to translate the first and second handles relative to each other between each of the plurality of relative positions.

In one feature, the slot and the carriage include teeth that are selectively engageable with each other to retain the handles in each of the plurality of relative positions except for the predetermined one of the plurality of relative positions. The slot has an end portion that is free of any of the teeth, and the first and second handles are positioned in the predetermined one of the plurality of relative positions when the carriage is located in the end portion of the slot.

According to one feature, the guide structure has a linear groove extending parallel to the linear slot, and the second jaw has a linear rib received in the linear groove for guided translation relative to the guide structure.

As a further feature, the guide structure has another linear groove extending parallel to the linear slot, the linear grooves are located on opposite sides of the guide structure, the second jaw has another linear rib received in the another linear groove for guided translation relative to the guide structure, and the second jaw has a pair of spaced side walls with one of the linear ribs fixed on one of the side walls and the other of the linear ribs fixed on the other of the side walls.

In one feature, the second handle and the second jaw have mating cam surfaces to transfer force from the second handle to the second jaw as the first and second handles are pivoted between the open and the gripping positions.

In a further feature, the first jaw has a concave recess defined by one of the mating cam surfaces and the first handle has a convex protrusion defined by the other of the mating cam surfaces.

According to one feature, the second surface is a planar, smooth surface and the third surface is an arcuate or angled surface having teeth or knurls formed thereon.

As one feature, the first jaw, the guide structure, and the first handle are a single unitary part.

BRIEF SUMMARY OF THE SEVERAL VIEWS OF THE DRAWINGS

FIG. 26A is a left side view of the plier wrench of FIG. 1 showing the handles translated relative to each other to a predetermined position as a first step that allows the reversible jaw component to be manually disengaged from the remainder of the plier wrench;

FIG. 26B is a view taken from line 26B-26B in FIG. 26A;

FIG. 26C is a section view taken from line 26C-26C in FIG. 26B;

DETAILED DESCRIPTION OF PREFERRED EMBODIMENTS

Figure 6:
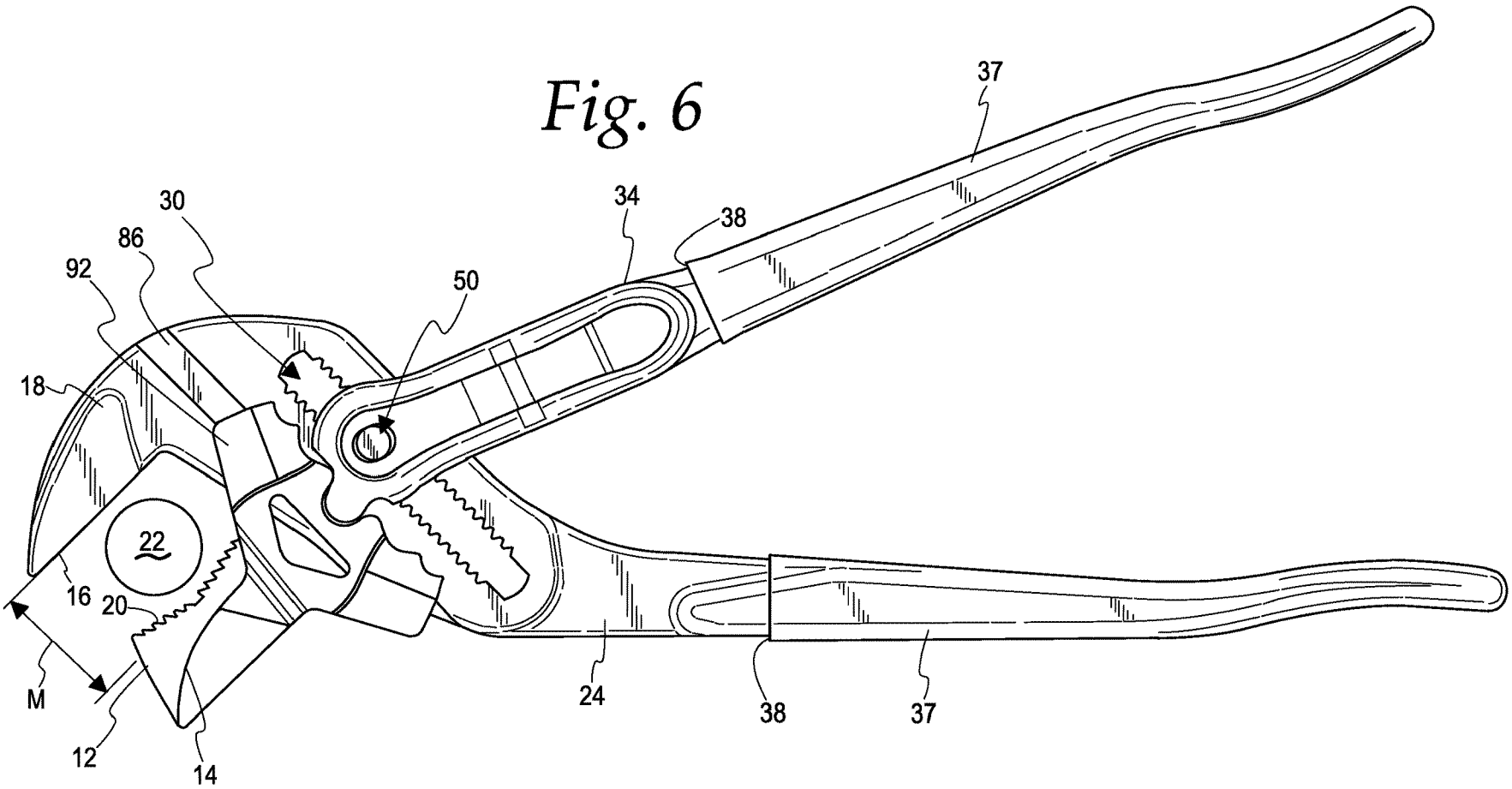
FIG. 6 is a view similar to FIG. 4, but showing the reversible jaw mounted on the wrench in an orientation reversed from that shown in FIGS. 1-5.
Figure 7:
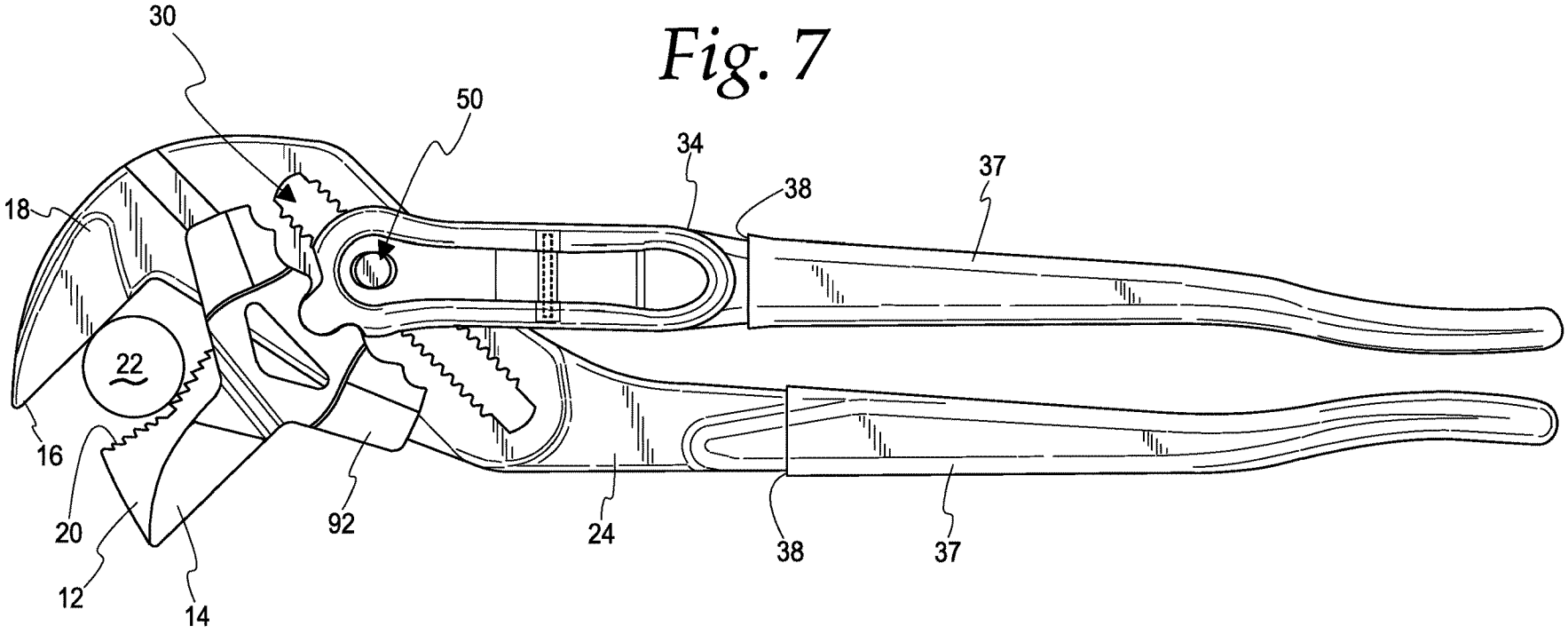
FIG. 7 is a view similar to FIG. 5, but showing the reversible jaw in the orientation of FIG. 6.

A plier wrench 10 according to this disclosure includes a reversible jaw 12 that can be selectively mounted to the remainder of the wrench 10 in either a first orientation (shown in FIGS. 1-5) or a second orientation (shown in FIGS. 6-7). With the jaw 12 mounted in the first orientation, a first workpiece engaging surface 14 on jaw 12 is opposed to a workpiece engaging surface 16 on a fixed jaw 18. When the jaw 12 is mounted in the second orientation that is "reversed" from the first orientation, a second workpiece engaging surface 20 on the jaw 12 is opposed to the workpiece engaging surface 16 on the fixed jaw 18. In the illustrated embodiment, each of the surfaces 14 and 16 are planar, smooth surfaces that are particularly useful for engaging the planar, smooth tool engagement surfaces provided on a fastener or other threaded fixture or component, whereas the surface 20 is an angled or arcuate shaped surface with teeth or knurls formed thereon that is particularly useful for engaging cylindrical sidewalls of pipes, tubing, conduit, and related connectors. While preferred shapes and finishes are shown herein for purposes of illustrations, it should be understood that other shapes and surface finishes, many of which are known, may be utilized for any or all of the surfaces 16, 18 and 20 according to this disclosure.

The jaw 12 can be manually switched between the first and second orientations by a user in order to optimize the wrench 10 for the specific workpiece 22 that the user wishes to engage between the jaws 12 and 18 of the wrench 10. In this regard, as will be explained in greater detail below, the jaw 12 can be manually engaged and disengaged from the wrench 10 while all the other components of the wrench 10 remain in their fully assembled condition, thereby allowing the user to conveniently and efficiently optimize the wrench 10 for each particular use without having to use any other tools to reverse the orientation of the jaw 12 or having to loosen or disassemble any of the other components of the wrench 10.

In the illustrated embodiment, the plier wrench 10 includes the reversible jaw 12, the fixed jaw 18, a first handle 24 having the jaw 18 fixed thereon (commonly referred to as the "top jaw" or the "hook handle"), a pivot mount 26, a pivot carriage 28 mounted in a linear slot 30 for selective translation of the carriage 28 and the pivot mount 26 along the linear length L of the slot 30 (best seen in FIGS. 8 and 9) relative to the first handle 24 and the fixed jaw 18, and a second handle 34 mounted on the pivot mount 26 to pivot about an axis 36 relative to the first handle 24. The pivot mount 26 is carried on the pivot carriage 28 and the pivot carriage 28 guides the second handle 34 for translation along the linear length L relative to the first handle 24 and the jaw 18 to a plurality of relative positions to provide gross adjustments to the gap M between the jaws 12 and 18 to accommodate different sizes of workpieces 22.

Each of the handles 24 and 34 include a grip portion 37 for engagement that allow a user's hand to grip the handles 24 and 34 to apply force to the jaws 12 and 18 via rotation of the handles 24 and 34 toward each other. Optionally and as shown in FIGS. 1-7 and 26A-28C, each of the grip portions 37 can include a grip cover or layer 38 made from a suitable material that, depending upon the requirements of the specific intended use of the wrench 10, can provide physical cushioning, thermal insulation and/or electrical insulation between the grip portion 37 and the user's hand.

Figure 9:
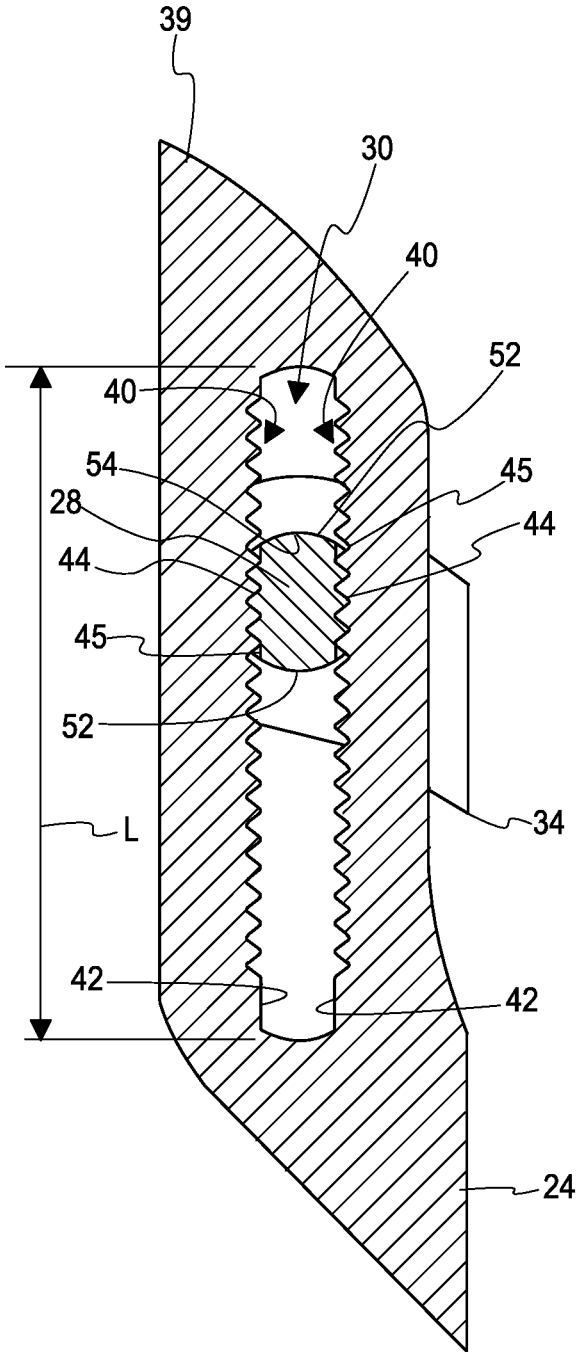
FIG. 9 is an enlarged partial section view taken from line 9-9 in FIG. 8.

In the illustrated embodiment, the slot 30 is provided in a guide structure 39 interposed between and fixed to the jaw 18 and the handle 24. As best seen in FIG. 9, the slot 30 includes a set of teeth 40 on each of the opposing long sides 42 of the slot 30, and the carriage 28 includes a set of teeth 44 on opposite sides 45 of the carriage 28. The teeth 44 are selectively engageable with the teeth 40 to retain the carriage 28 at each of the plurality of relative positions along the length L. This allows the handles 24 and 34 to be translated relative to each other along the length L and then to be retained in each of the plurality of relative positions while the handles 24 and 34 are pivoted relative to each other to translate the reversible jaw 12 relative to the fixed jaw 18 between an open position, shown in FIGS. 4 and 6, wherein a workpiece 22 can be received between the jaws 12 and 18 and a gripping position, shown in FIGS. 5 and 7, wherein the workpiece 22 can be gripped between the jaws 12 and 18. The carriage 28 is mounted to translate along the axis 36 perpendicular to the length L so as to selectively engage and disengage the teeth 44 with the teeth 40 at each position along the length L. A button lever 46 is provided to bias the carriage 28 in a direction (shown by arrow A in FIG. 8) that urges and/or maintains the teeth 40 and 44 in engagement until a user actuates the carriage 28 in an opposite direction (shown by arrow B in FIG. 8) by pressing on an end portion 48 of the lever 46 to disengage the teeth 44 from the teeth 40.

Figure 2:
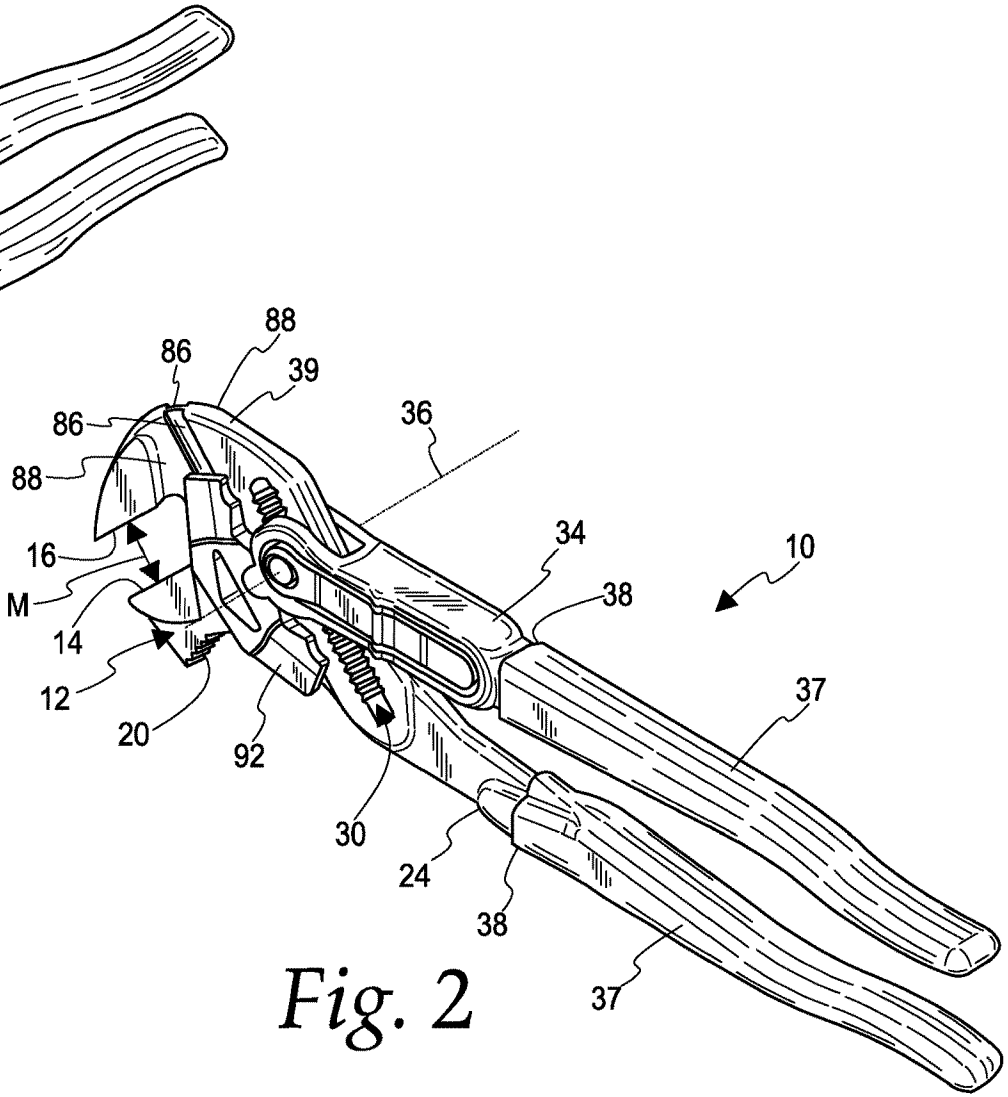
FIG. 2 is a perspective view from the back and above of the plier wrench of FIG. 1.
Figure 1:
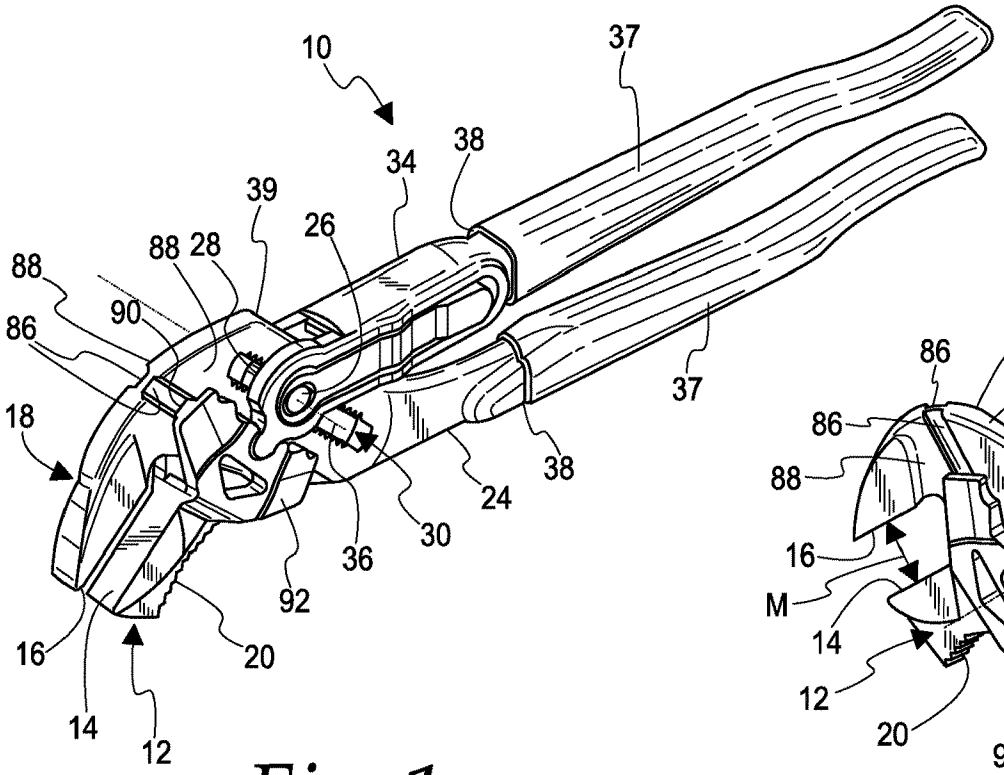
FIG. 1 is a perspective view from the front and above of one embodiment of a plier wrench having a removable and reversible jaw according to this disclosure.
Figure 3:
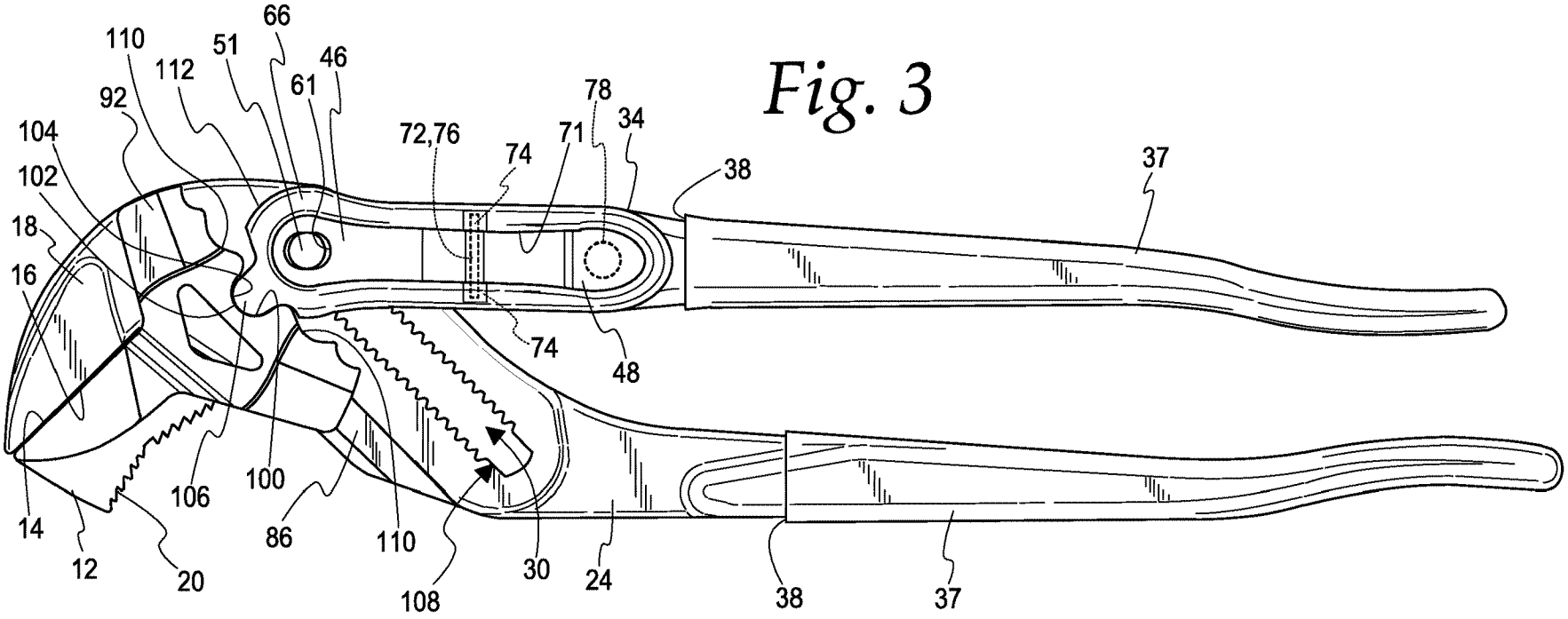
FIG. 3 is a left side view of the plier wrench of FIG. 1 with the plier wrench and its handles shown in a fully closed position.
Figure 4:
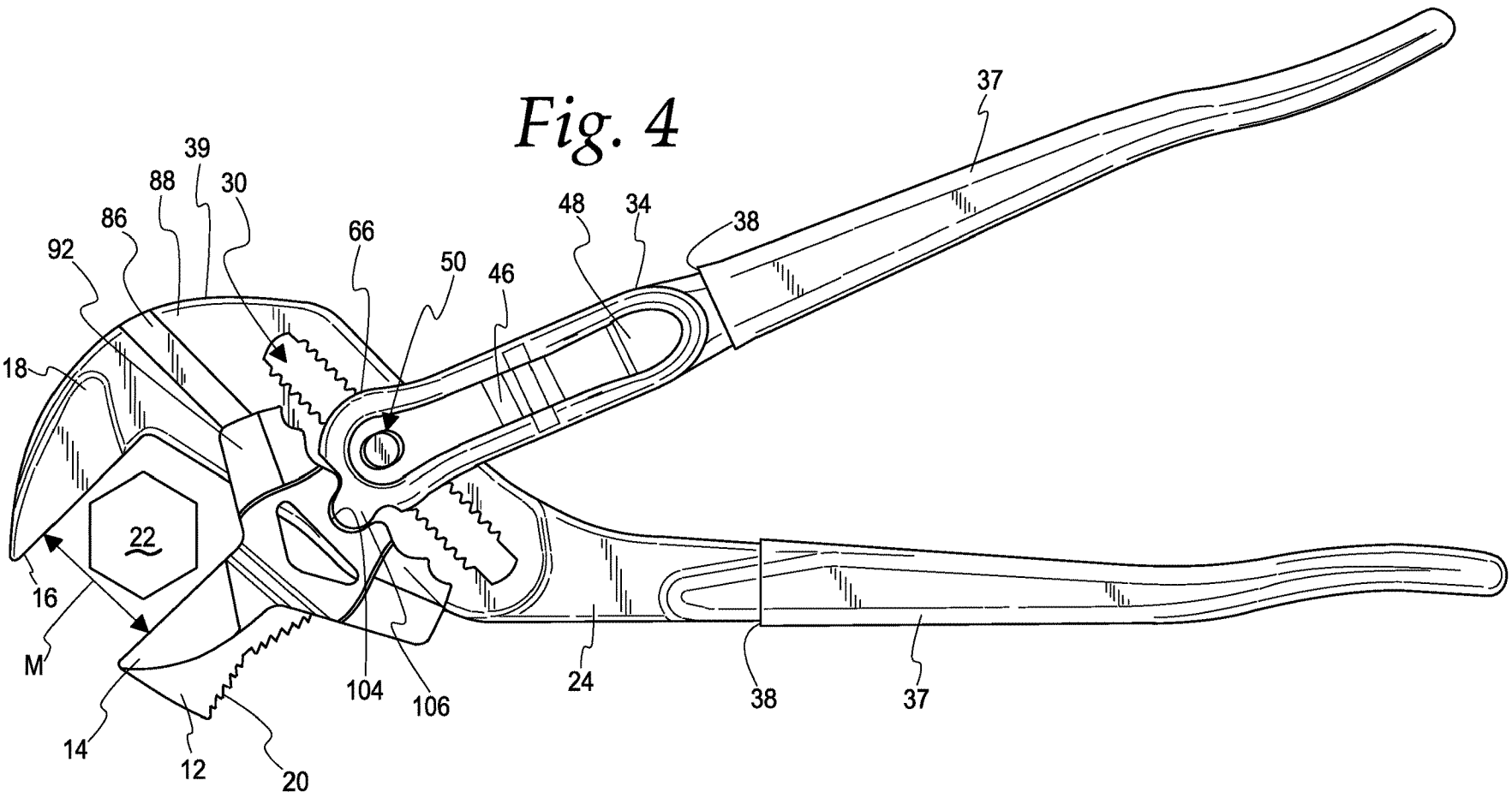
FIG. 4 is a view similar to FIG. 3, but showing the plier wrench and its handles in an open position wherein a workpiece can be received between jaws of the plier wrench.
Figure 5:
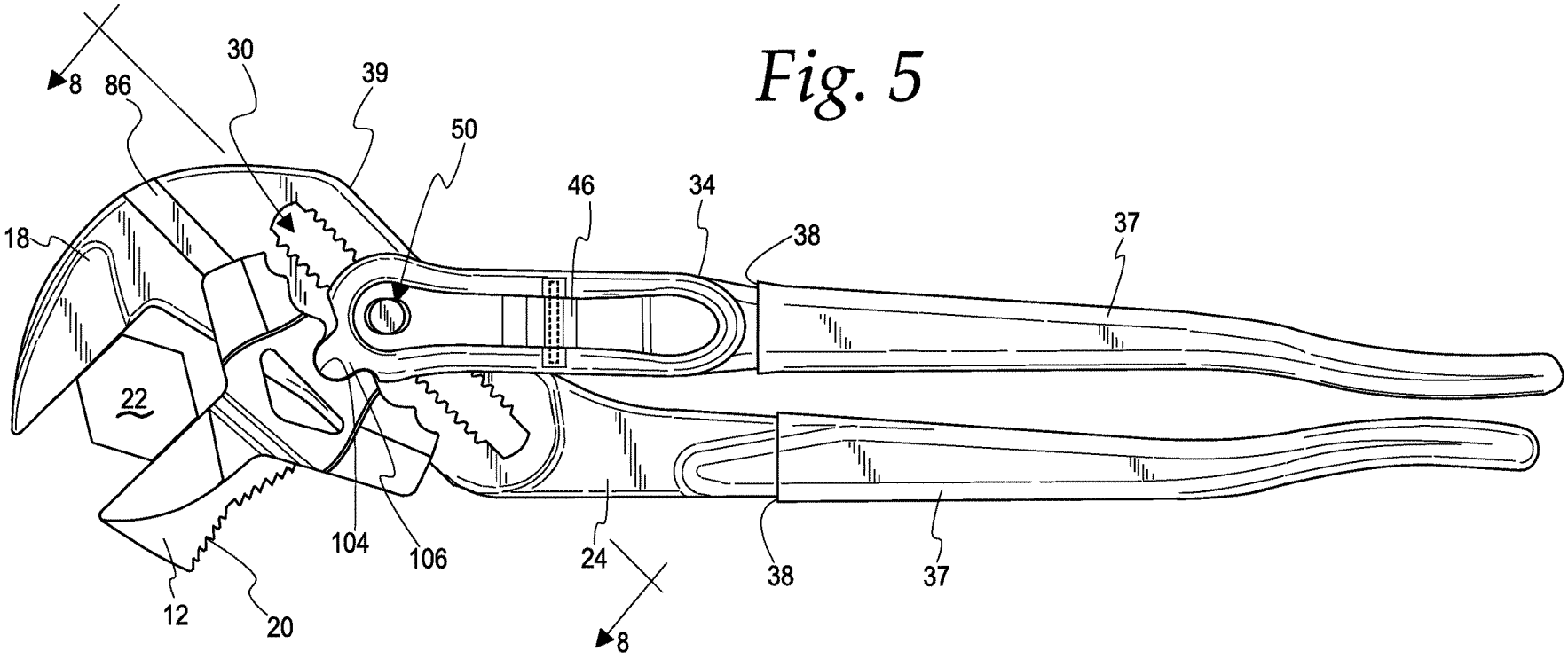
FIG. 5 is a view similar to FIGS. 3 and 4, but showing the plier wrench and its handles in a gripping position wherein a workpiece can be gripped between the jaws of the plier wrench.
Figure 8:
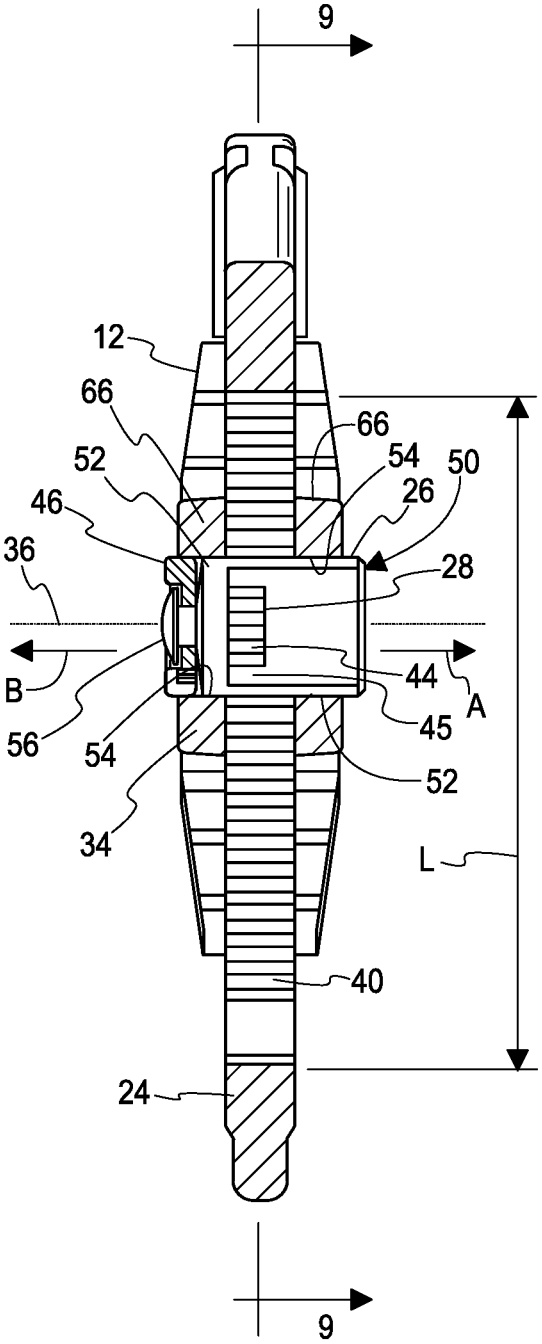
FIG. 8 is an enlarged, partial section view taken from line 8-8 in FIG. 5, with a pivot carriage shown un-sectioned for purposes of illustration.
Figure 11:
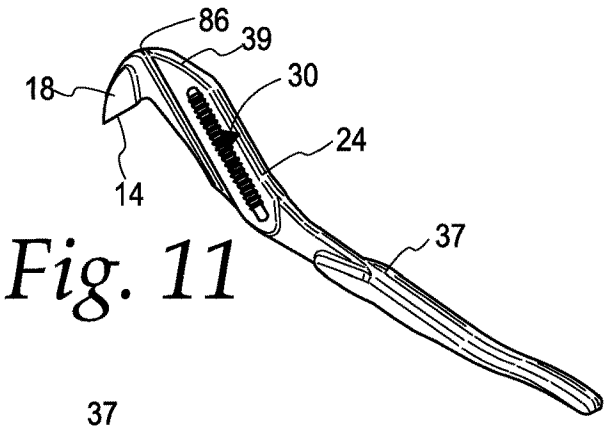
FIG. 11 is a perspective view from the back and above of the unitary jaw and handle component.
Figure 10:
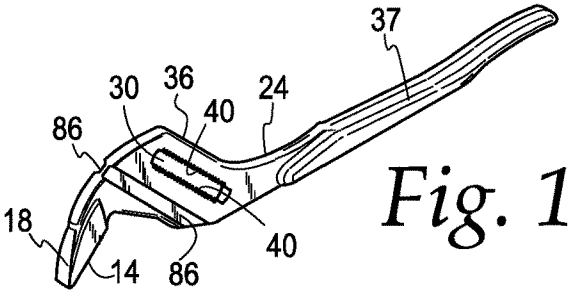
FIG. 10 is a perspective view from the front and above of a unitary jaw and handle component of the plier wrench of FIG. 1.
Figure 13:
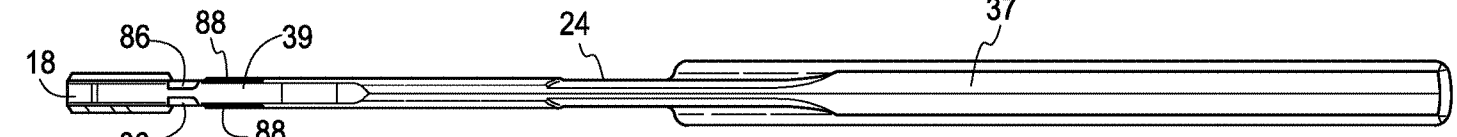
FIG. 13 is a view taken from line 13-13 in FIG. 12.
Figure 12:
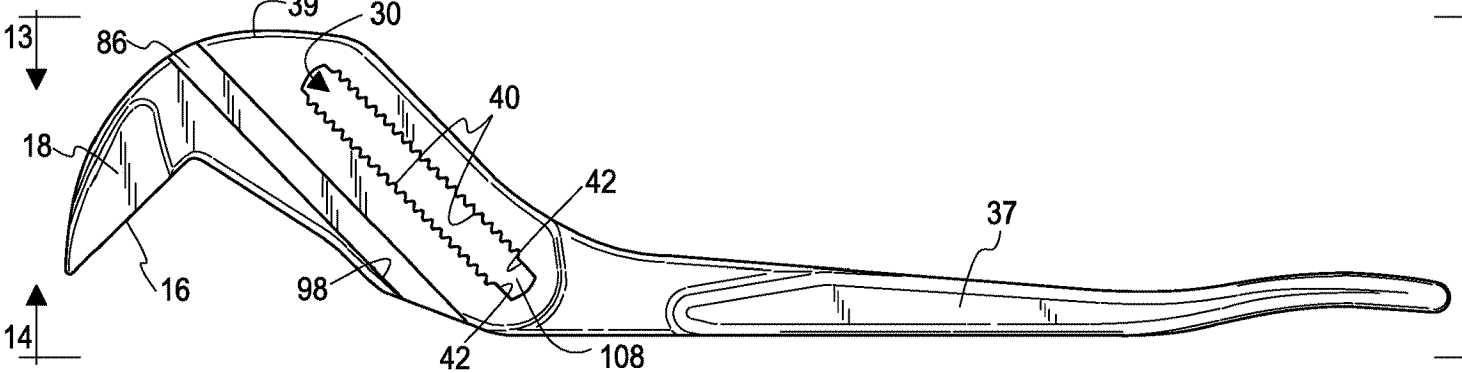
FIG. 12 is a left side view of the unitary jaw and handle component.
Figure 14:
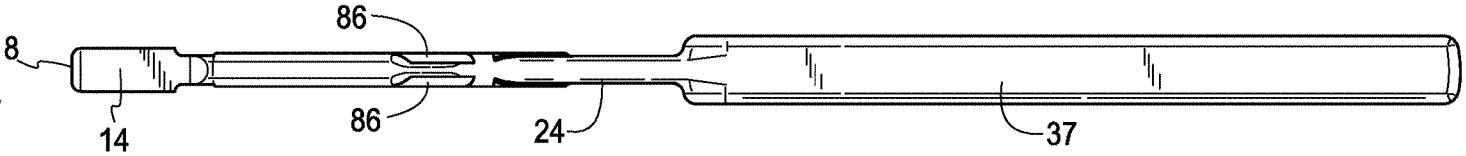
FIG. 14 is a view taken from line 14-14 in FIG. 12.
Figure 16:
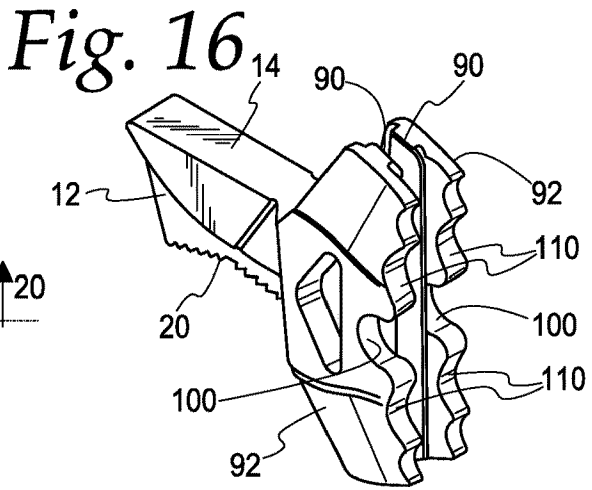
FIG. 16 is a perspective view from the back and above of the reversible jaw component.

As best seen in FIG. 8, the carriage 28 and the pivot mount 26 are provided as a single unitary piece 50 (i.e. formed from a continuous piece of material) that includes all the functional features of the carriage 28 and pivot mount 30. In this regard the unitary piece 50 includes three of the teeth 44 on each of the sides 45, and cylindrical surfaces 52 of the pivot mount 26 that mate with cylindrical bores 54 in the handle 34 to provide the pivot mounting of the handle 34 and the guided translation of the carriage 28 along the axis 36. Additionally, the unitary pivot/carriage piece 50 includes a head feature 56 defining opposed shoulder surfaces that are abutted by oppositely facing surfaces on the lever 46 to transfer force from the lever 46 to the piece 50. As best seen in FIG. 3, the head feature 55 is received in a slightly elongated slot 61 formed in the lever 46 Features similar to the features 26, 28, 30, 46, and 50 of the plier wrench 10 are known and some examples that can be utilized in the wrench 10 according to this disclosure are explained in further detail in U.S. Pat. No. 4,581,960 naming Putsch et al. as inventors, the entire disclosure of which is incorporated herein by reference.

Figures 21, 22, 23, 24, 25:
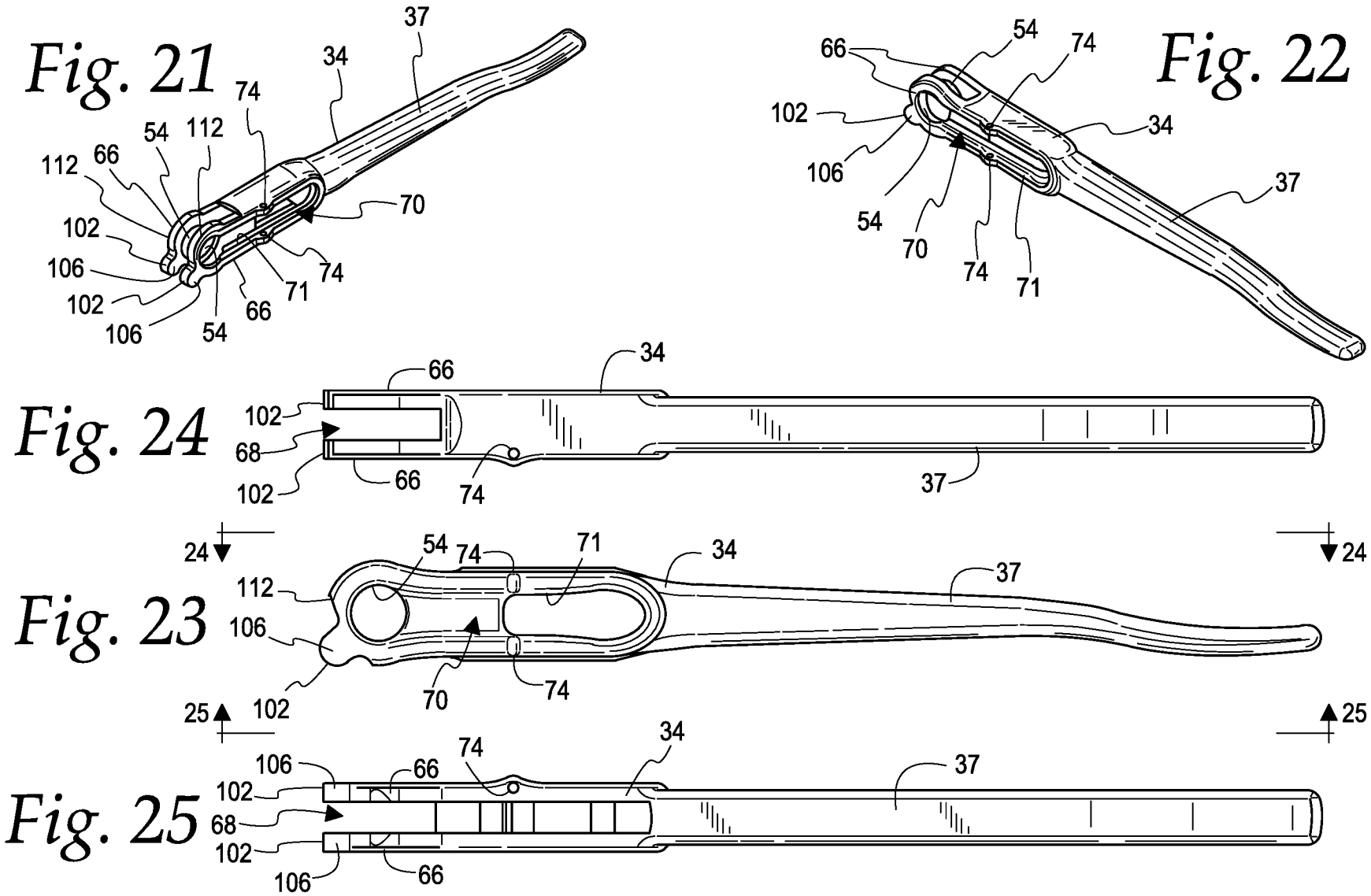
FIG. 21 is a perspective view from the front and above of a handle component of the plier wrench of FIG. 1.
FIG. 22 is a perspective view from the back and above of the handle component of FIG. 21.
FIG. 23 is a left side view of the handle component of FIG. 21.
FIG. 24 is a view taken from line 24-24 in FIG. 23.
FIG. 25 is a view taken from line 25-25 in FIG. 23.

The handle 34 in the illustrated embodiment include a pair of spaced side walls 66 defining a u-shaped groove 68 (best seen in FIG. 23) that receives the guide structure 39. The side walls 66 restrain relative lateral movement between the handle 34 and the guide structure 39, and each of the side walls 66 contains one of the bores 54 that receives the cylindrical surfaces 52 of the pivot mount 26. In the illustrated embodiment, the handle 34 further includes a relief 70 that receives the lever 46 and that has a perimeter shape 71 loosely conforming to the shape of the outer perimeter of the lever 46 As best seen in FIG. 3, the lever 46 is retained in the relief 70 by a pivot pin 72 that is press fit into bores 74 formed in the handle 34 and that extend into a bore 76 formed in the lever 46 to pivot mount the lever 46. A helical spring, shown at 78 in FIG. 3, is mounted between the handle 34 and an inwardly facing surface on the end portion 48 of the lever 46 to bias the lever 46 against the unitary pivot/carriage piece 50 which in turn biases the carriage 28 in the direction shown by arrow A in FIG. 8 to maintain the teeth 40 and 44 in engagement until a user presses the end portion 48 of the lever 46 to overcome the bias force of the spring 78 and pivot the lever 46 so as to move the carriage 28 in the direction shown by arrow B in FIG. 8 to disengage the teeth 40 and 44. In the illustrated embodiment, the helical spring 78 is located relative to the lever 46 by a protrusion or bump formed on the inwardly facing side of the end portion 48 of the lever 46. The use of a similar lever is known, as shown by the lever (18) in EP 2 636 489 B1.

It should be understood that while a preferred configuration has been shown for the pivot mount 26, the carriage 28, the slot 30, and the lever 46 other configurations that provide the function of these features may be desirable depending upon the particular applications intended for the plier wrench 10 and that any suitable configuration can be utilized in the plier wrench 10, including any of the configurations described or mentioned in U.S. Pat. No. 3,534,641 naming Le Duc as inventor; U.S. Pat. No. 7,455,000 naming Lucke et al. as inventors; and U.S. Pat. No. 8,895,463 naming Herrmann as inventor, the entire disclosures of which are incorporated herein by reference.

Figure 20:
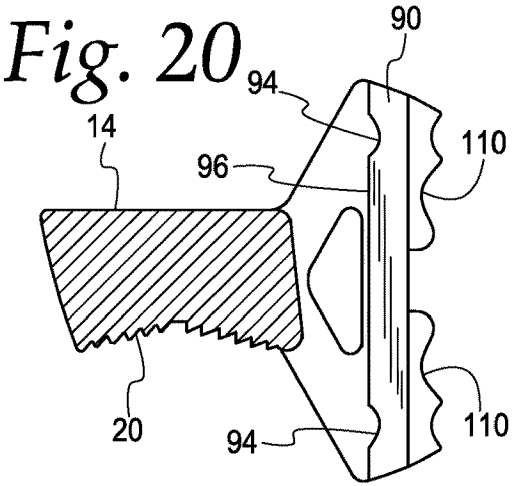
FIG. 20 is a section view taken from line 20-20 in FIG. 18.
Figure 18:
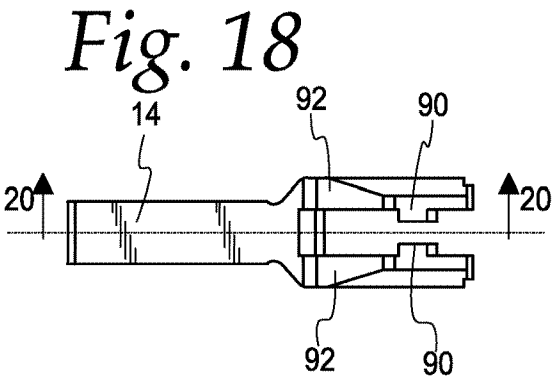
FIG. 18 is a view taken from line 18-18 in FIG. 17.
Figure 17:
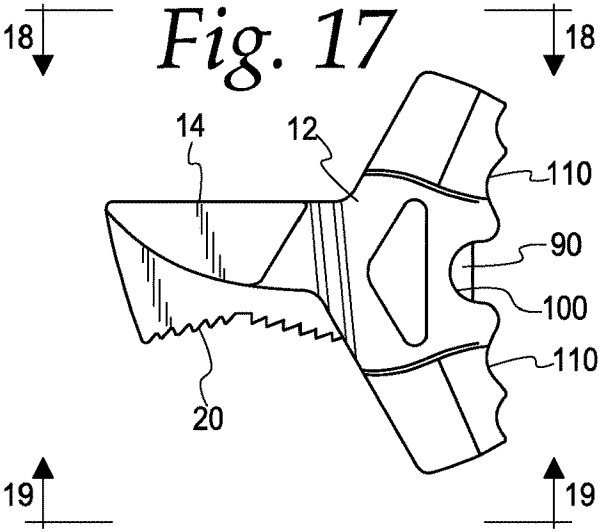
FIG. 17 is a left side view of the reversible jaw component.
Figure 15:
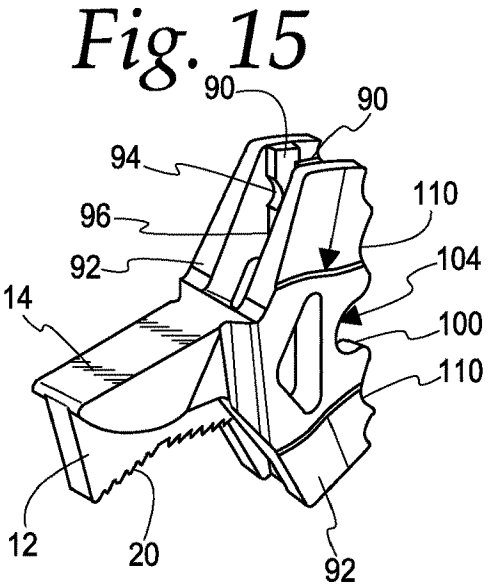
FIG. 15 is a perspective view from the front and above of the reversible jaw component of the plier wrench of FIG. 1.
Figure 19:
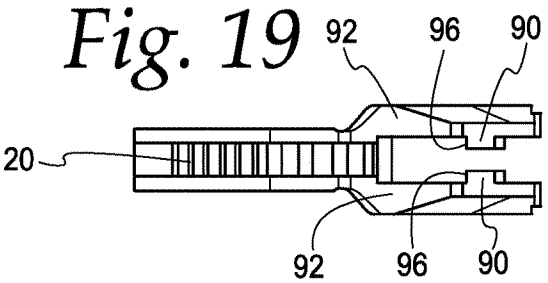
FIG. 19 is a view taken from line 19-19 in FIG. 17.

The guide structure 39 includes a pair of linear grooves 86 located on opposite sides 88 of the guide structure 39, and the jaw 12 includes a pair of linear ribs 90 fixed on a pair of spaced side walls 92 of the jaw 12. In the illustrated embodiment, the grooves 86 extend parallel to the slot 30. Each of the ribs 90 is received in a corresponding one of the grooves 86 for guided translation relative to the guide structure 39, the jaw 18 and the handle 24. The grooves 86 and the ribs 90 preferably have conforming shapes that assist in the guided translation. The use of grooves and ribs similar to the grooves 86 and ribs 90 is known, as illustrated by the grooves (7) and ribs (11) shown in FIGS. 1-9 of EP 0 421 107 B1 naming inventors Putsch et al. In the embodiment illustrated herein and as best seen in FIG. 20, each of the ribs 90 includes a pair of concave reliefs 94 formed in a side wall 96 of the rib 90 adjacent each end portions of the rib. As will be explained in further detail below, the reliefs 94 provide clearance between each rib 90 and the sidewall 98 of the corresponding groove 86 that allows for the manual removal of the jaw 12.

As best seen in FIG. 3, the jaw 12 and the handle 34 have mating cam surfaces 100 and 102 formed on each of their side walls 92 and 66, respectively, to transfer force from the handle 34 to the jaw 12 as the handles 24 and 34 are pivoted between the open and the gripping positions. Each side wall 92 of the jaw 12 has a concave recess 104 defined by a one of the cam surfaces 100, and each side wall 66 of the handle 34 has a convex protrusion 106 defined by one of the cam surfaces 102. Similar cam surfaces are known, with some examples being shown in previously mentioned U.S. Pat. No. 7,455,000 and EP 0 421 107 B1; and one example of alternate cam surfaces being shown in previously mentioned U.S. Pat. No. 3,534,641.

Figure 27A:
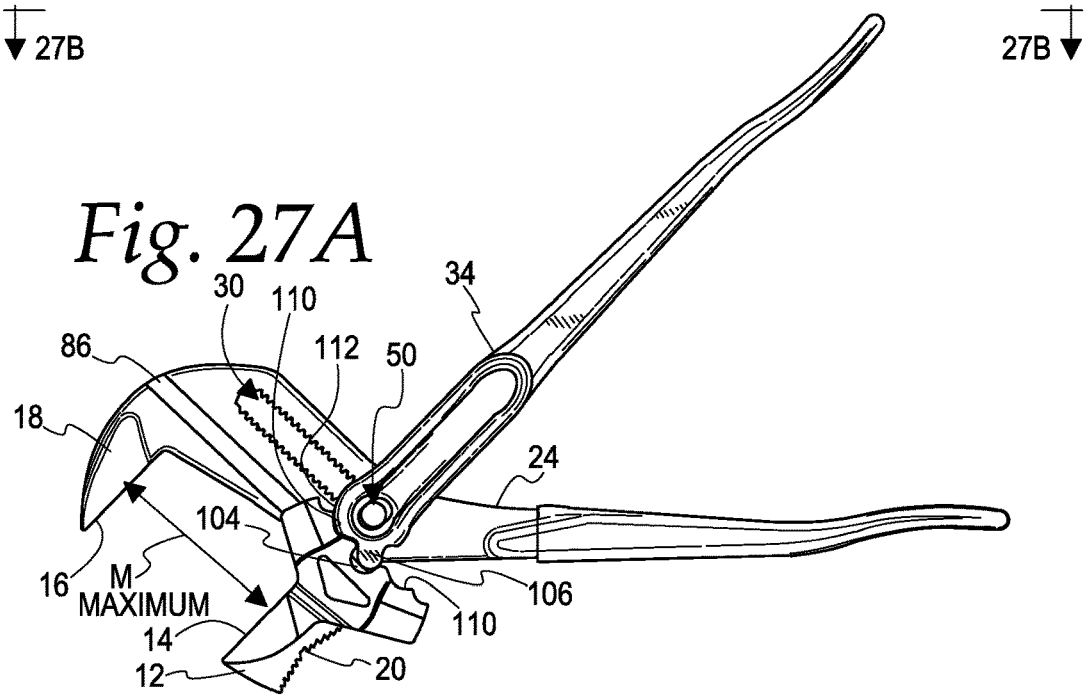
FIG. 27A is a view similar to FIG. 26A, but showing the handles of the plier wrench pivoted relative to each other to a release position as a second step that allows the reversible jaw component to be manually disengaged from the remainder of the plier wrench.
Figure 27B:
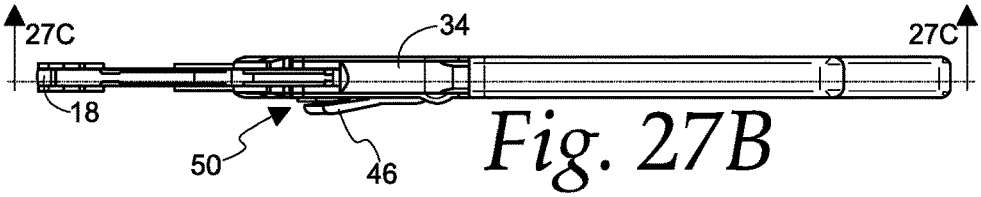
FIG. 27B is a view taken from line 27B-27B in FIG. 27A.
Figure 27C:
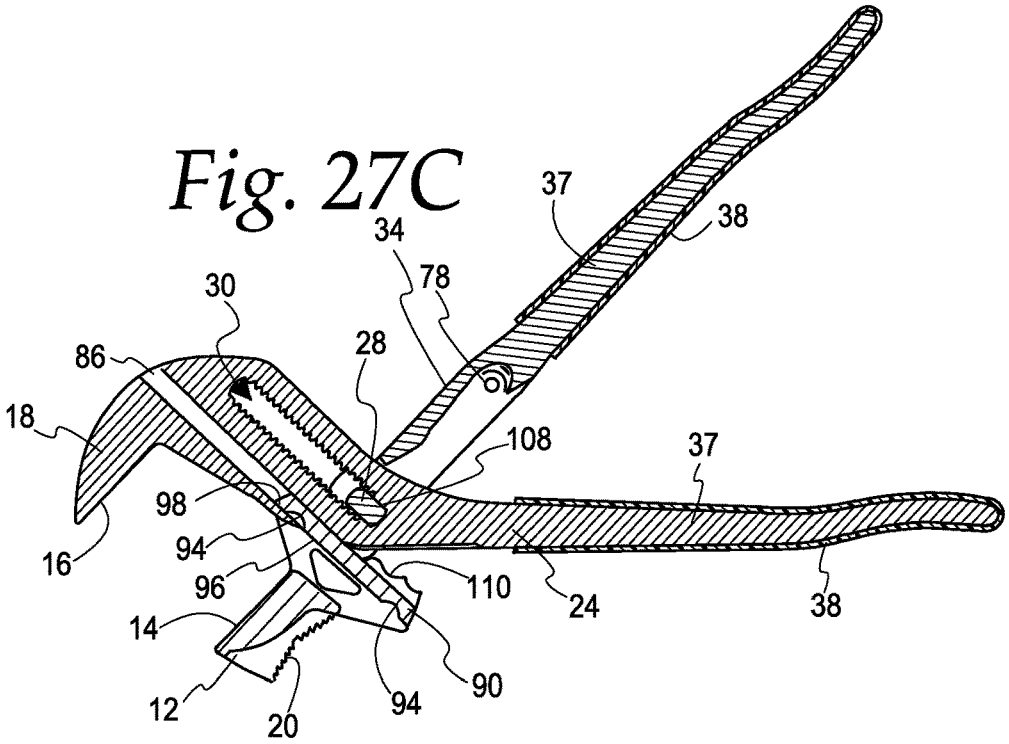
FIG. 27C is a section view taken from line 27C-27C in FIG. 27B.
Figure 28A:
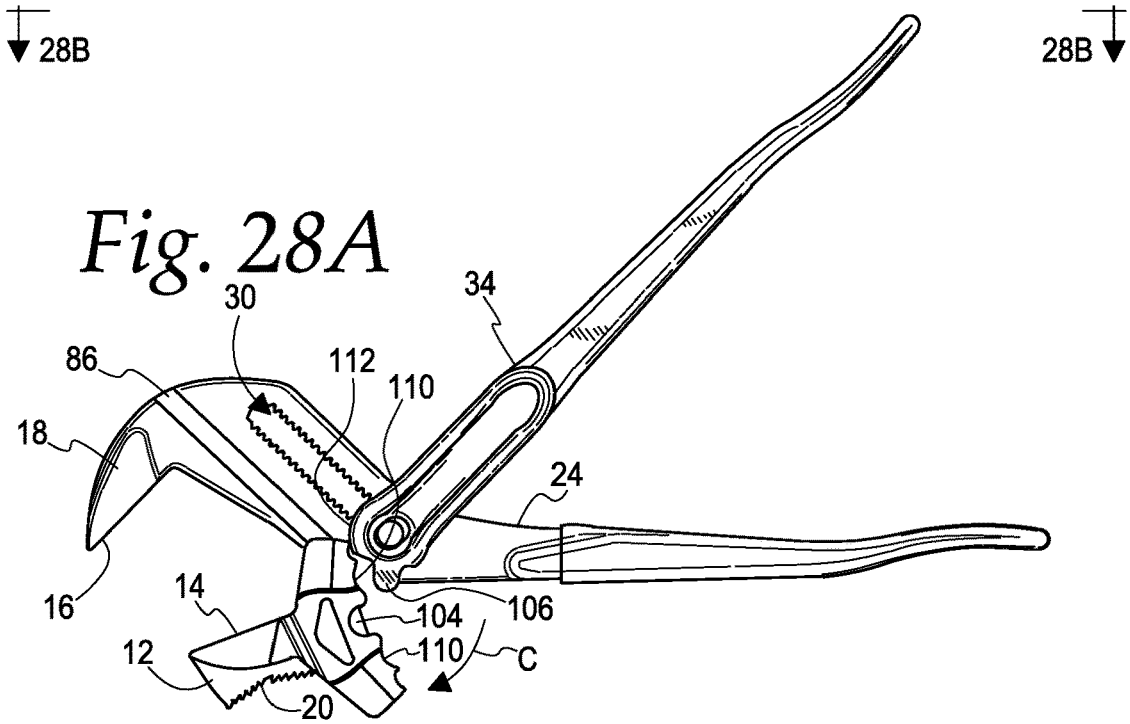
FIG. 28A is a view similar to FIGS. 26A and 28A, but showing the reversible jaw component after it has been rotated relative to the remainder of the plier wrench as it is disengaged from the remainder of the plier wrench.
Figure 28B:
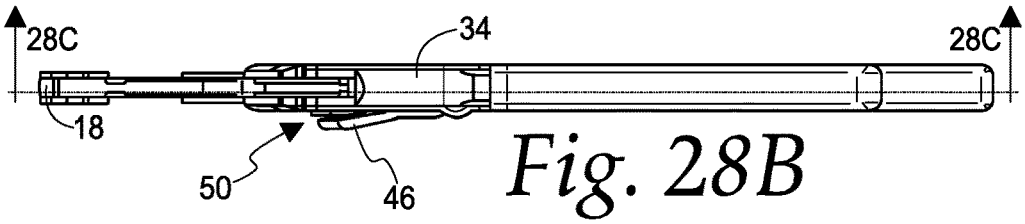
FIG. 28B is a view taken from line 28B-28B in FIG. 28A.
Figure 28C:
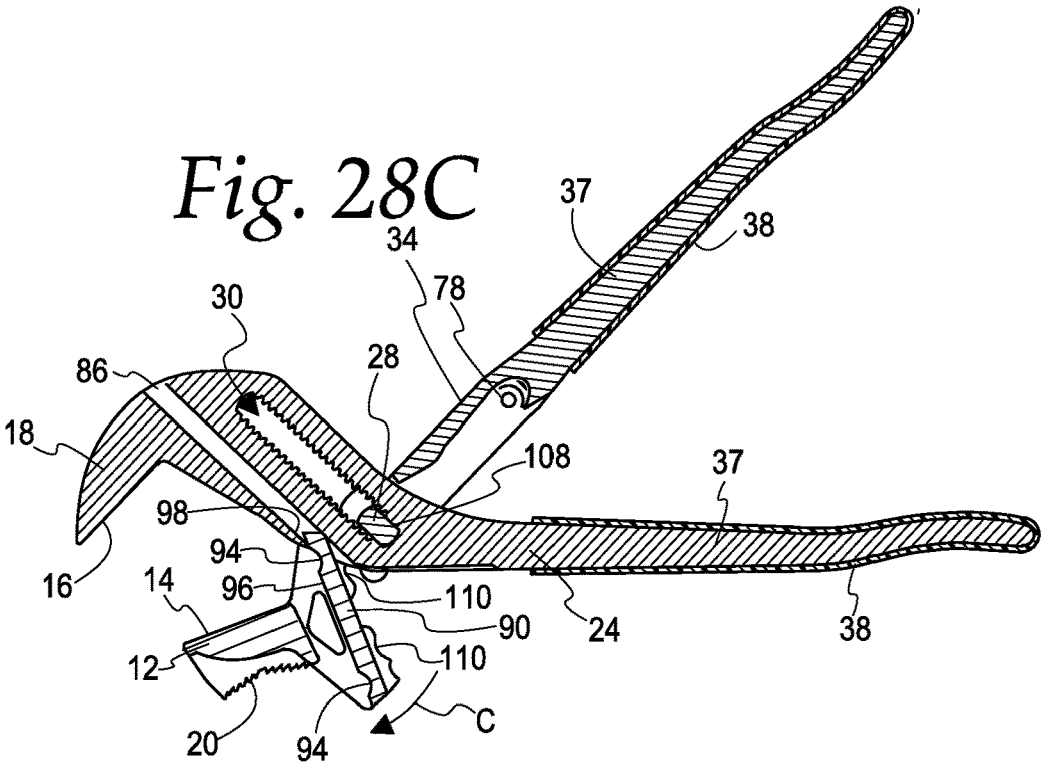
FIG. 28C is a section view taken from line 28C-28C in FIG. 28B.

As seen in FIGS. 26A-28C, the jaw 12 can be manually removed from the rest of the wrench 10 without requiring any disassembly of the wrench 10 or any loosening of any components of the wrench 10. To remove the jaw 12 from the remainder of the wrench 10, a user first actuates the carriage 28 along the axis 36 to disengage the teeth 44 from the teeth 40, which allows the user to then translate the carriage 28 and handle 34 along the length L to the lower end 108 of the slot 30. This is the lowermost relative position of the handles 24 and 34 and which provides the largest possible gap M, as shown in FIGS. 26A and 26C. The user can then manually pivot the handles 24 and 34 to the release position, as shown in FIGS. 27A and 27C, which disengages the protrusion 106 from the recess 104. In this regard, it can be seen that the surfaces 110 on the jaw 12 adjacent the recess 104 are shaped so as not interfere with the surface 112 of the handle 34 adjacent the protrusion 106, which allows the handle 34 to be rotated to the release position when the jaw 12 is in either the first or the second orientation. It should be appreciated that although specific and preferred shapes are shown for the surfaces 110 and 112, any other shapes that allow the handle 34 to be rotated to the release position may be used according to this disclosure. Next, as shown in FIGS. 28A-28C, the user can manually rotate the jaw 12 in the direction of arrow C (clockwise in FIGS. 28A and 28C), to disengage the ribs 90 from the grooves 86 and to remove the jaw 12 from the remainder of the wrench 10. In this regard, it can be seen in FIG. 28C that the reliefs 94 prevent interference between the sidewalls 96 and 98 of the ribs 90 and the grooves 86, respectively, which allows for the rotation of the jaw 12 relative to the guide structure 39 and the remainder of the wrench 10. Once removed, the jaw 12 can be reversed to the second orientation (shown in FIGS. 6 and 7) and reengaged with the remainder of the wrench 10 to as to place the surface 20 opposite the surface 16. In this regard, the jaw 12 can be reengaged with the remainder of the wrench 10 by performing the above described procedure in reverse order, with the jaw 12 first being rotated counter-clockwise in FIGS. 28A and 28C to align the ribs 90 and the grooves 86, and then the handle 34 then being rotated from the release position toward the handle 24.

While the shape of the grooves 86, the ribs 90 and the reliefs 94 are preferred, it should be understood that other configuration and shapes are possible that would provide guided translation of the jaw along a linear or curvilinear path relative to the guide structure 39 while allowing rotation of the jaw 12 relative to the guide structure 39 and the remainder of the wrench 10 at a predetermined position, and this disclosure anticipates that such shaped can and will be used for the wrench 10. For example, the lowermost end of the side wall 98 of each groove 86 could be curved and the sidewall 96 of each rib 90 could remain straight (without the relief) in order to allow the desired rotation of the jaw 12. Furthermore, it should be understood that other configurations and shapes that allow removal of the jaw 12 without any rotation relative to the guide structure 39 may also be used according to this disclosure. For example, if each of the ribs 90 where shortened so that they terminated at a location inboard of the reliefs 94 shown in the illustrated embodiment, the jaw 12 could simply be disengaged from the guide structure 39 and the remainder of the wrench 10 by translating the ribs 90 out of the 86 with the handles 24 and 34 in the release position, with the surfaces 110 and 112 being shaped to allow such translation with the handles 24 and 34 in the release position. It should be appreciated that the illustrated embodiments allow for the ribs 90 to extend as far as possible along the sidewalls 92 of the jaw 12, thereby maximizing the structural integrity of the wrench 10 during use.

When the carriage 28 is located in the end 108 of the slot 30, the teeth 44 are prevented from engaging the teeth 40 because the sides 42 in the end 108 are free of the teeth 40, thereby maintaining the unitary pivot/carriage piece 50 in a position where it extends laterally from the wrench 10 along the axis 36. As best seen in FIGS. 26B, 27B and 28B, this provides a visual indication to a user that the wrench 10 is not in a ready condition to engage a workpiece.

Preferred embodiments of the inventive concepts are described herein, including the best mode known to the inventor(s) for carrying out the inventive concepts. Variations of those preferred embodiments will become apparent to those of ordinary skill in the art upon reading the foregoing description. The inventor(s) expect skilled artisans to employ such variations as appropriate, and the inventor(s) intend that the inventive concepts can be practiced otherwise than as specifically described herein. Accordingly, the inventive concepts disclosed herein include all modifications and equivalents of the subject matter recited in the claims appended hereto as permitted by applicable law. Moreover, any combination of the above-described elements and features in all possible variations thereof is encompassed by the inventive concepts unless otherwise indicated herein or otherwise clearly contradicted by context. Further in this regard, while highly preferred forms of the components and features of the plier wrench 10 are shown in the figures, it should be understood that this disclosure anticipates variations in the specific details of each of the disclosed components and features of the wrench 10 and that no limitation to a specific form, configuration, or detail is intended unless expressly and specifically recited in an appended claim.

For example, in the illustrated embodiment, the jaw 18, the handle 24 and the guide structure 39 are provided as a single unitary piece (i.e., formed from a single continuous piece of material). While the unitary piece is a highly preferred construction, other constructions may be desirable, such as, for example, a construction wherein one or more of the jaw 18, the guide structure 39, and the grip portion 64, are provided as a separate component piece that is then fixed to the remaining of the features 18, 52, and 54 using suitable fasteners or other joining means.

As another example, while the surfaces 14 and 20 and the sidewalls 92 of the jaw 12 are illustrated as a single unitary piece (i.e., formed from a single continuous piece of material), other constructions may be desirable, such as, for example, a construction wherein one or both of the sidewalls 92 are provided as a separate component piece that is then fixed to the remaining features of the jaw 12.

In a further example, while the sidewalls 66 and the grip portion 37 of the handle 34 are illustrated as a single unitary piece (i.e., formed from a single continuous piece of material), other constructions may be desirable, such as, for example, a construction wherein one of both of the sidewalls 66 are provided as a separate component piece that is then fixed to the remaining features of the handle 34.

As yet another example, while the helical spring 78 is preferred for use with the lever 46, other types of springs, many of which are known, may be utilized. Furthermore, while the lever 46 is preferred, a leaf spring similar to the leaf spring (18) shown in U.S. Pat. No. 4,581,960 or the leaf spring (16) in U.S. Pat. No. 8,695,464 could be substituted for the lever 46, with an end surface of the unitary pivot/carriage piece 50 being used to actuate the piece 50 against the bias force of the leaf spring.

As another example, while the teeth 40 and 44 are shown with a particular shape, geometry, and orientations, other shapes, geometries and orientations may be employed depending upon the requirements of each application. Two examples of alternate shapes, geometries, and orientations are shown in commercially available pump pliers sold by Klein Tools as part numbers D504-10 ("Classic Klaw™ Pump Pliers, 10-inch") and D504-10B ("Quick-Adjust Klaw™ Pump Pliers, 10-inch").

As a further example, while the pivot mount 26 and the carriage 28 are shown as the single unitary piece 50, in some applications it may be desirable for the pivot mount 26 and carriage 28 to be separate components that are assembled together.

In another example, while the pivot pin 72 is illustrated and described a being press fit into the bores 74, other fixing means may be used to secure the pin 72 in the bores 74, such as, for example, peening, threaded engagement, or mechanical bonding.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to better illuminate the inventive concepts disclosed herein and does not pose a limitation on the scope of any invention unless expressly claimed. No language in the specification should be construed as indicating any non-claimed element as essential to the practice of the inventive concepts disclosed herein.

All references, including publications, patent applications, and patents, cited herein are hereby incorporated by reference to the same extent as if each reference were individually and specifically indicated to be incorporated by reference and were set forth in its entirety herein.

What is claimed is:

1. An adjustable plier wrench comprising:

a first jaw including a first surface to engage a workpiece;

a second jaw including a second surface to engage a workpiece;

a first handle having the first jaw fixed thereon; and a second handle; and wherein the first and second handles are operably engaged to translate relative to each other between a plurality of relative positions and to pivot relative to each other at each of the plurality of relative positions, the second handle is operably engaged with the second jaw to translate the second jaw relative to the first jaw as the first and second handles are translated to each of the plurality of relative positions, the second handle is operably engaged with the second jaw to translate the second jaw relative to the first jaw between an open position where a workpiece can be received between the surfaces of the jaws and a gripping position where a workpiece is gripped by the surfaces of the jaws in response to the first and second handles being pivoted relative to each other as each of the plurality of relative positions, and the second jaw is configured to be manually disengaged from and reengaged to the remainder of the wrench without any disassemble of the remainder of the wrench with the first and second handles translated to a predetermined one of the plurality of relative positions and pivoted relative to each other to a jaw release position.

2. The wrench of claim 1 wherein the second jaw has a third surface to engage a workpiece, the second jaw surface and the third jaw surface face in opposite directions, the second jaw can be selectively mounted on the remainder of the wrench in a first mounted orientation where the second jaw surface faces the first jaw surface to grip a workpiece therebetween or a second mounted orientation where the third jaw surface faces the first jaw surface to grip a workpiece therebetween.

3. The wrench of claim 2 wherein the second surface is a planar, smooth surface and the third surface is an arcuate or angled surface having teeth or knurls formed thereon.

4. The wrench of claim 2 wherein the first jaw and the first handle are a single unitary part.

5. The wrench of claim 4 wherein the unitary part has a linear slot formed therein, the second handle is pivot mounted to a carriage, and the carriage is mounted in the slot to translate the first and second handles relative to each other between each of the plurality of relative positions.

6. The wrench of claim 5 wherein the slot and the carriage comprise teeth that are selectively engageable with each other to retain the handles in each of the plurality of relative positions except for the predetermined one of the plurality of relative positions, the slot has an end portion that is free of any of the teeth, and the first and second handles are positioned in the predetermined one of the plurality of relative positions when the carriage is located in the end portion of the slot.

7. The wrench of claim 4 wherein the unitary part has a linear groove extending parallel to the linear slot, and the second jaw has a linear rib received in the linear groove for guided translation relative to the unitary part.

8. The wrench of claim 7 wherein the unitary part has another linear groove extending parallel to the linear slot, the linear grooves are located on opposite sides of the unitary part, the second jaw has another linear rib received in the another linear groove for guided translation relative to the unitary part, and the second jaw has a pair of spaced side walls with one of the linear ribs fixed on one of the side walls and the other of the linear ribs fixed on the other of the side walls.

9. The wrench of claim 2 wherein the second handle and the second jaw have mating cam surfaces to transfer force from the second handle to the second jaw as the first and second handles are pivoted between the open and the gripping positions.

10. The wrench of claim 9 wherein the second jaw has a concave recess defined by one of the mating cam surfaces and the second handle has a convex protrusion defined by the other of the mating cam surfaces.

11. An adjustable plier wrench comprising:

a first jaw including a first surface to engage a workpiece;

a second jaw including:

a second surface to engage a workpiece, and a third surface to engage a workpiece, the second jaw surface and the third jaw surface facing in opposite directions;

a first handle fixed to the first jaw; and a second handle; and wherein the first and second handles are operably engaged to translate relative to each other between a plurality of relative positions and to pivot relative to each other at each of the plurality of relative positions, the second handle is operably engaged with the second jaw to translate the second jaw relative to the first jaw as the first and second handles are translated to each of the plurality of relative positions, the second handle is operably engaged with the second jaw to translate the second jaw relative to the first jaw between an open position where a workpiece can be received between the surfaces of the jaws and a gripping position where a workpiece is gripped by the surfaces of the jaws in response to the first and second handles being pivoted relative to each other as each of the plurality of relative positions, and the second jaw can be selectively mounted on the remainder of the wrench in a first mounted orientation where the second jaw surface faces the first jaw surface to grip a workpiece therebetween or a second mounted orientation where the third jaw surface faces the first jaw surface to grip a workpiece therebetween.

12. The wrench of claim 11 wherein:

the wrench further comprises a guide structure fixed to the first jaw and the first handle intermediate the first jaw and the first handle; and the second jaw is configured to be manually disengaged from and reengaged to the remainder of the wrench without any disassemble of the remainder of the wrench with the first and second handles translated to a predetermined one of the plurality of relative positions and pivoted relative to each other to a jaw release position.

13. The wrench of claim 12 wherein the guide structure has a linear slot formed therein, the second handle is pivot mounted to a carriage, and the carriage is mounted in the slot to translate the first and second handles relative to each other between each of the plurality of relative positions.

14. The wrench of claim 13 wherein the slot and the carriage comprise teeth that are selectively engageable with each other to retain the handles in each of the plurality of relative positions except for the predetermined one of the plurality of relative positions, the slot has an end portion that is free of any of the teeth, and the first and second handles are positioned in the predetermined one of the plurality of relative positions when the carriage is located in the end portion of the slot.

15. The wrench of claim 13 wherein the guide structure has a linear groove extending parallel to the linear slot, and the second jaw has a linear rib received in the linear groove for guided translation relative to the guide structure.

16. The wrench of claim 15 wherein the guide structure has another linear groove extending parallel to the linear slot, the linear grooves are located on opposite sides of the guide structure, the second jaw has another linear rib received in the another linear groove for guided translation relative to the guide structure, and the second jaw has a pair of spaced side walls with one of the linear ribs fixed on one of the side walls and the other of the linear ribs fixed on the other of the side walls.

17. The wrench of claim 11 wherein the second handle and the second jaw have mating cam surfaces to transfer force from the second handle to the second jaw as the first and second handles are pivoted between the open and the gripping positions.

18. The wrench of claim 11 wherein the second jaw has a concave recess defined by one of the mating cam surfaces and the second handle has a convex protrusion defined by the other of the mating cam surfaces.

19. The wrench of claim 11 wherein the second surface is a planar, smooth surface and the third surface is an arcuate or angled surface having teeth or knurls formed thereon.

20. The wrench of claim 11 wherein the first jaw, the guide structure, and the first handle are a single unitary part.

* * * * *